US006553288B2

(12) United States Patent
Taguchi et al.

(10) Patent No.: US 6,553,288 B2
(45) Date of Patent: Apr. 22, 2003

(54) VEHICLE TRAVELING CONTROL SYSTEM AND VEHICLE CONTROL DEVICE

(75) Inventors: Koji Taguchi, Toyota (JP); Masayuki Usami, Toyota (JP); Tomonobu Takashima, Kawasaki (JP)

(73) Assignees: Fujitsu Limited, Kawasaki (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/208,755

(22) Filed: Aug. 1, 2002

(65) Prior Publication Data

US 2002/0188388 A1 Dec. 12, 2002

Related U.S. Application Data

(63) Continuation of application No. 09/663,706, filed on Sep. 18, 2000, now abandoned.

(30) Foreign Application Priority Data

Nov. 10, 1999 (JP) ..... 11-319259

(51) Int. Cl.[7] ..... G08G 1/16

(52) U.S. Cl. ..... 701/23; 701/28; 701/301; 340/436; 340/903; 180/167

(58) Field of Search ..... 701/23, 28, 93, 701/96, 300, 301; 340/903, 435, 436; 342/455; 180/167, 168, 169, 170, 179; 318/587; 348/148

(56) References Cited

U.S. PATENT DOCUMENTS

| | | | | |
|---|---|---|---|---|
| 5,039,217 | A | 8/1991 | Maekawa et al. | 701/96 |
| 5,295,551 | A | 3/1994 | Sukonick | 180/167 |
| 5,331,561 | A | 7/1994 | Barrett et al. | 701/96 |
| 5,835,880 | A | 11/1998 | Gan et al. | 701/301 |
| 6,032,097 | A | 2/2000 | Iihoshi et al. | 701/96 |
| 6,128,559 | A | 10/2000 | Saitou et al. | 701/301 |
| 6,285,929 | B1 | 9/2001 | Hashimoto | 701/301 |
| 6,313,758 | B1 | 11/2001 | Kobayashi | 701/301 |

FOREIGN PATENT DOCUMENTS

| | | |
|---|---|---|
| JP | 10-038560 | 2/1998 |
| JP | 11-038560 | 2/1998 |
| JP | 11-053689 | 2/1999 |

*Primary Examiner*—Gary Chin
(74) *Attorney, Agent, or Firm*—Staas & Halsey LLP

(57) ABSTRACT

A vehicle traveling control system and a vehicle control device whereby markers are detected with reliability and information about a local vehicle is transmitted to a succeeding vehicle. Information collecting unit of a preceding vehicle acquires information about the traveling state of the local vehicle associated therewith and supplies the acquired information to modulating unit. The modulating unit modulates the information supplied thereto and supplies the modulated information to blinking unit. The blinking unit causes the markers to blink in accordance with the information supplied thereto. Imaging unit of the succeeding vehicle acquires images of the markers and supplies the acquired images to specifying unit. The specifying unit specifies the marker images from within the image data output from the imaging unit. Validity determining unit determines validity of the specified marker images. Using the marker images, distance measuring unit measures a distance to the preceding vehicle. Demodulating unit demodulates information superimposed on the markers to reproduce the original information. In accordance with the information obtained from the distance measuring unit and the demodulating unit, control unit controls the traveling state of the local vehicle associated therewith.

12 Claims, 20 Drawing Sheets

VEHICLE TRAVELING CONTROL SYSTEM AND VEHICLE CONTROL DEVICE

This application is a continuation of application Ser. No. 09/663,706, filed Sep. 18, 2000, now abandoned, the disclosure of which is incorporated herein by reference.

BACKGROUND OF THE INVENTION

1. Field of the Invention

The present invention relates to a vehicle traveling control system and a vehicle control device, and more particularly, to a vehicle traveling control system and a vehicle control device for controlling a local vehicle by looking up information from markers affixed to a vehicle ahead.

2. Description of the Related Art

According to ITS (Intelligent Transport System) or the like, for example, a method is proposed in which the speed of a local vehicle is controlled so that the distance to a vehicle ahead (hereinafter referred to as preceding vehicle) may always be kept constant, to thereby lighten the burden on the driver.

To materialize such control, it is necessary that the distance between the local vehicle and the preceding vehicle be accurately measured.

Conventionally, a method has been employed in which, for example, the parallax of two markers affixed to the rear surface of the preceding vehicle is optically detected to obtain the distance between the vehicles.

With this method, however, in cases where two vehicles are traveling ahead side by side, for example, it is likely that a marker of one vehicle and a marker of the other will be erroneously recognized as a pair of markers, giving rise to a problem that the control can possibly be performed erroneously.

Also, according to ITS, it desirable that individual vehicles recognize the traveling states of other vehicles to control the local vehicle in accordance therewith. To permit exchange of information between vehicles, however, a communication device needs to be additionally provided, giving rise to a problem that the cost increases.

SUMMARY OF THE INVENTION

An object of the present invention is to provide a vehicle traveling control system and a vehicle control device which ensure high safety and yet are low in cost.

To achieve the object, there is provided a vehicle traveling control system for controlling a succeeding vehicle by looking up information from markers affixed to a preceding vehicle. In the vehicle traveling control system, the preceding vehicle has blinking means for blinking the markers according to a predetermined pattern, and the succeeding vehicle has imaging means for acquiring an image of light from the markers, specifying means for specifying images of the markers from within the image output from the imaging means, and validity determining means for determining validity of the marker images based on a blinking pattern of the marker images specified by the specifying means.

To achieve the above object, there is also provided a vehicle control device for controlling a local vehicle associated therewith by looking up information from markers affixed to a preceding vehicle. The vehicle control device comprises imaging means for acquiring an image of light from the markers of the preceding vehicle, specifying means for specifying images of the markers from an output of the imaging means, and validity determining means for determining validity of the marker images based on a blinking pattern of the marker images specified by the specifying means.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Embodiments of the present invention will be hereinafter described with reference to the drawings.

Figure 1:
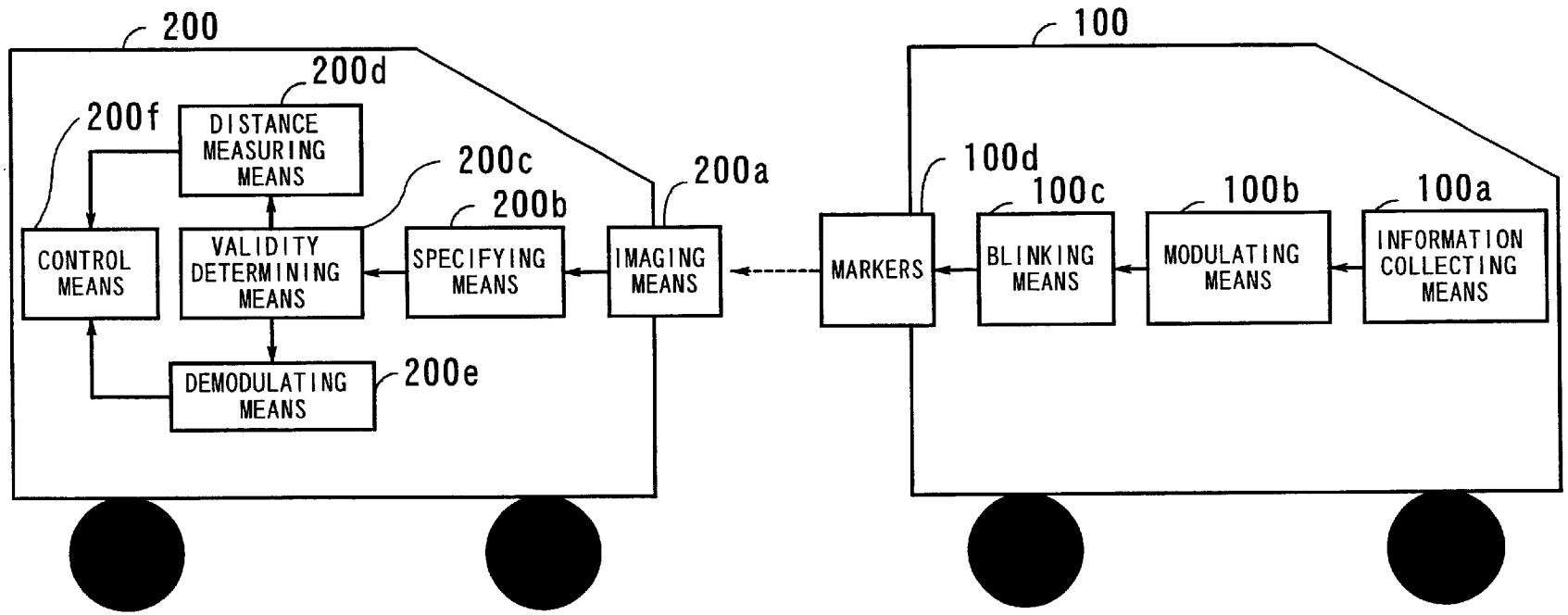
FIG. 1 is a diagram illustrating the operation according to the present invention.

FIG. 1 illustrates the principle of operation according to the present invention. As shown in the figure, a preceding vehicle 100 has information collecting means 100*a,* modulating means 100*b,* blinking means 100*c,* and markers 100*d.*

The information collecting means 100*a* collects information indicative of the traveling state of the local vehicle associated therewith (e.g., vehicle speed, acceleration, yaw angle, etc.).

The modulating means 100*b* controls the blinking means 100*c* in accordance with the information collected by the information collecting means 100*a,* thereby to superimpose the information on the blinking pattern of the markers 100*d.*

In accordance with the information supplied from the modulating means 100*b,* the blinking means 100*c* causes the markers 100*d* to blink according to a predetermined pattern.

The markers 100*d* comprise two panels, each of which has a plurality of LEDs (Light Emitting Diodes) arranged in matrix form and capable of emitting near-infrared rays with a wavelength in the vicinity of 900 nm, for example.

On the other hand, a succeeding vehicle 200 has imaging means 200*a,* specifying means 200*b,* validity determining means 200*c,* distance measuring means 200*d,* demodulating means 200*e,* and control means 200*f.*

The imaging means 200*a* acquires an image of light from the markers 100*d* and outputs corresponding image data.

The specifying means 200*b* specifies images of the markers 100*d* (hereinafter referred to as marker images) from within the image data output from the imaging means 200*a.*

In accordance with the blinking pattern of the marker images specified by the specifying means 200*b,* the validity determining means 200*c* determines validity of the detected marker images.

The distance measuring means 200*d* calculates the distance to the preceding vehicle 100 based on a distance between the marker images, and supplies the calculated distance to the control means 200*f.*

The demodulating means 200*e* demodulates the original information from the blinking pattern of the marker images, and supplies the information to the control means 200*f.*

The operation in accordance with the principle illustrated in FIG. 1 will be now described.

Let it be assumed that the vehicle 100 ahead and the vehicle 200 behind are standing with a certain distance therebetween. If the vehicle 100 in this state starts to move, the information collecting means 100*a* detects a change in the speed of the local vehicle associated therewith and notifies the modulating means 100*b* of the change.

In accordance with local vehicle information (in this case, speed of the local vehicle) supplied from the information collecting means 100*a,* the modulating means 100*b* controls the blinking means 100*c.*

The blinking means 100*c* blinks the markers 100*d* according as it is controlled by the modulating means 100*b,* so that the vehicle 200 behind can be notified of the change of the vehicle speed by means of an optical signal.

The markers 100*d* are made up of two panels, as described above, and these panels emit light according to an identical pattern.

In the vehicle 200 behind, the imaging means 200*a* acquires an image of the light from the markers 100*d* of the preceding vehicle 100, and outputs corresponding image data to the specifying means 200*b.*

The specifying means 200*b* subjects the image data output from the imaging means 200*a* to predetermined image processing, thereby to specify marker images corresponding to the two panels.

The validity determining means 200*c* checks the blinking pattern of the marker images specified by the specifying means 200*b,* to determine whether the specified marker images are valid or not. In this example, it is determined whether or not the light emission patterns of the two panels constituting the markers 100*d* are identical with each other, to thereby determine the validity of the marker images. If, as a result, it is judged that the marker images are valid, the marker images are supplied to the distance measuring means 200*d* and the demodulating means 200*e.*

The distance measuring means 200*d* calculates the distance to the preceding vehicle 100 by applying triangulation, for example, to the distance between the two marker images supplied from the validity determining means 200*c.* Specifically, the distance between the two panels constituting the markers 100*d* is known; therefore, the distance between the marker images is calculated, and using the calculated distance, the distance between the vehicles is obtained. The distance obtained is supplied to the control means 200*f.*

Based on the distance supplied from the distance measuring means 200*d,* the control means 200*f* drives actuators, not shown, to control the traveling state of the local vehicle associated therewith. In this example, the preceding vehicle 100 has started, and accordingly, the distance between the vehicles measured by the distance measuring means 200*d* gradually increases. Consequently, in order to keep the distance between the vehicles constant, the control means 200*f* releases the brake and then opens the throttle of the engine to start the local vehicle.

At this time, the demodulating means 200*e* is already supplied with information indicating the change of the speed of the preceding vehicle 100, and therefore, the control means 200*f* determines a suitable throttle opening etc. by also looking up this information.

As the preceding vehicle 100 starts to travel at a constant speed, the succeeding vehicle 200 is controlled by the control means 200*f* such that the distance to the preceding vehicle 100 is kept constant, and thus follows the preceding vehicle 100 at the same speed.

If, during such constant-speed travel, the preceding vehicle 100 is suddenly braked to avoid danger or for some other reason, the information collecting means 100*a* detects the braking and notifies the modulating means 100*b* of same. The modulating means 100*b* drives the blinking means 100*c* in accordance with the information indicative of the braking. As a result, the information indicative of the braking is transmitted from the markers 100*d.*

In the succeeding vehicle 200, the demodulating means 200*e* demodulates the original information from the blinking pattern of the markers 100*d* and supplies the information to the control means 200*f.*

The control means 200*f* detects the braking of the preceding vehicle 100 and thus operates the brake of the local vehicle associated therewith, whereby the local vehicle decelerates.

The above sequence of processes is performed electrically and thus is executed in a very short period of time. Consequently, it is possible to avoid the danger of collision with the preceding vehicle 100.

As described above, in the vehicle traveling control system according to the present invention, the validity determining means 200*c* determines validity of the specified marker images based on the blinking pattern of the markers 100*d,* whereby the markers 100*d* of the preceding vehicle 100 can be detected with reliability.

Also, information about the preceding vehicle 100 is transmitted to the succeeding vehicle 200 by means of the blinking pattern of the markers 100*d*. Accordingly, information about braking and the like, for example, can be quickly transmitted to the succeeding vehicle 200, making it possible to avoid a traffic accident. Further, the distance between the vehicles can be decreased without impairing safety, thus contributing toward easing traffic congestion.

An embodiment of the present invention will be now described.

Figure 2:
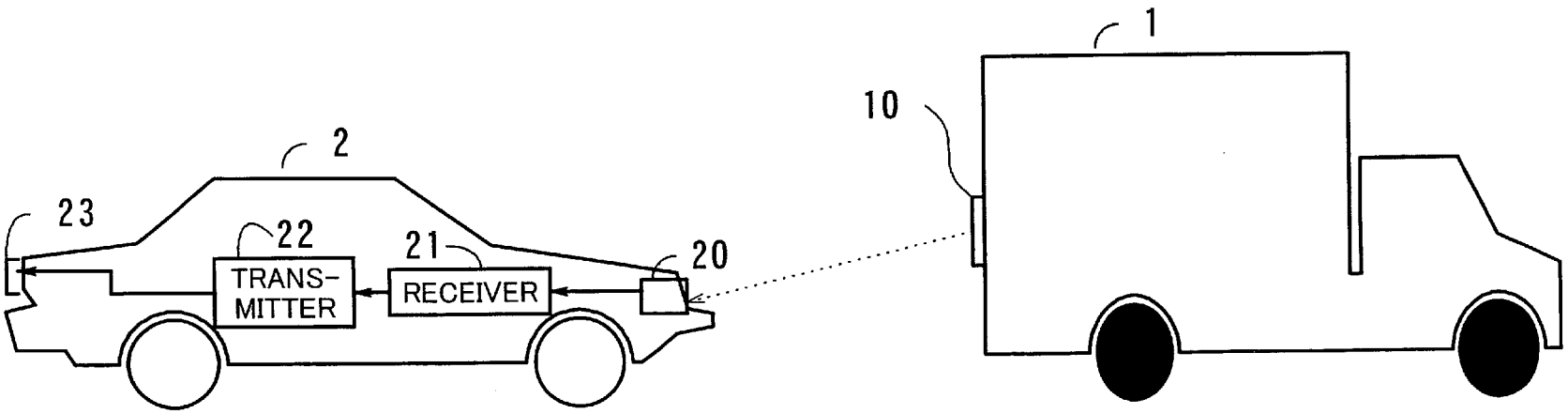
FIG. 2 is a diagram schematically illustrating the configuration according to an embodiment of the present invention.

FIG. 2 schematically illustrates the configuration according to the embodiment of the invention, by way of example. In the figure, markers are affixed to the rear of a preceding vehicle 1.

Figure 3:
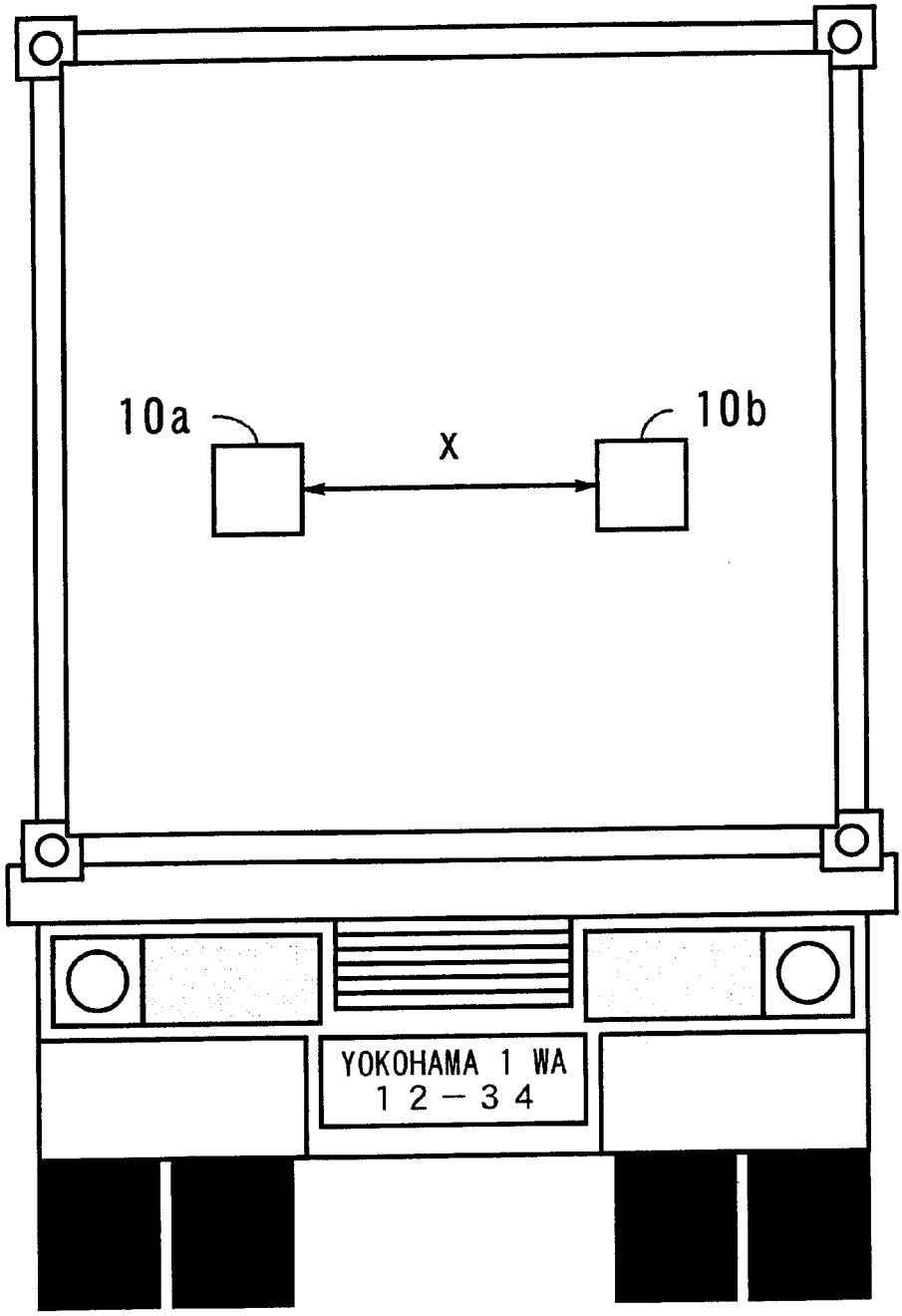
FIG. 3 is a diagram showing a preceding vehicle in FIG. 2 as viewed from behind.

FIG. 3 shows the preceding vehicle 1 as viewed from behind. As shown in the figure, markers 10*a* and 10*b* are arranged on the rear of the preceding vehicle 1 at a predetermined distance x from each other such that the markers are parallel with the ground. Each of the markers 10*a* and 10*b* has a plurality of LEDs arranged in matrix form for emitting near-infrared rays with a wavelength in the vicinity of 900 nm.

Referring again to FIG. 2, a succeeding vehicle 2 is equipped with a light receiving section 20, a receiver 21, a transmitter 22,and markers 23. The arrangement of the preceding vehicle 1 also is identical with that of the succeeding vehicle but is omitted from the figure for simplicity of illustration.

The light receiving section 20 receives an optical image of the markers 10, converts the image to corresponding image data, and outputs the data.

The receiver 21 is supplied with the image data output from the light receiving section 20 and subjects the input data to predetermined image processing, to calculate the distance to the preceding vehicle 1 and a yaw angle.

Figure 4:
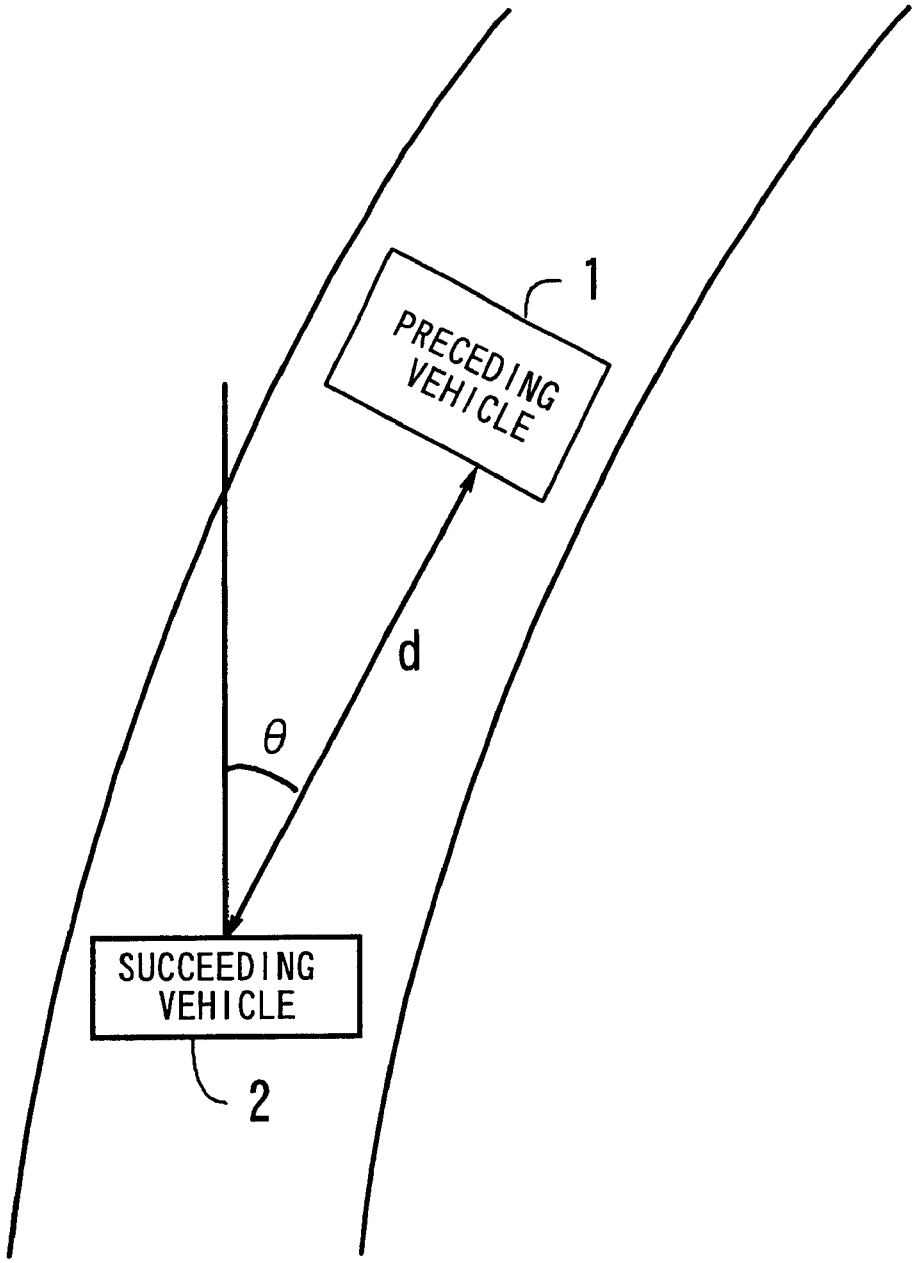
FIG. 4 is a diagram illustrating a vehicles and a yaw angle.

FIG. 4 illustrates the distance between the vehicles and the yaw angle. As shown in the figure, the distance d between the vehicles denotes a distance between the rear of the preceding vehicle 1 and the front of the succeeding vehicle 2. Also, the yaw angle 0 denotes an angular difference between the advancing direction of the preceding vehicle 1 and that of the succeeding vehicle 2.

Referring again to FIG. 2, the transmitter 22 drives the markers 23 in accordance with the information indicative of the traveling state of the local vehicle associated therewith as well as the information transmitted from the preceding vehicle 1, to transmit these items of information to a succeeding vehicle, not shown.

The markers 23 have an arrangement identical with that shown in FIG. 3 and thus each have a plurality of LEDs arranged in matrix form.

Figure 5:
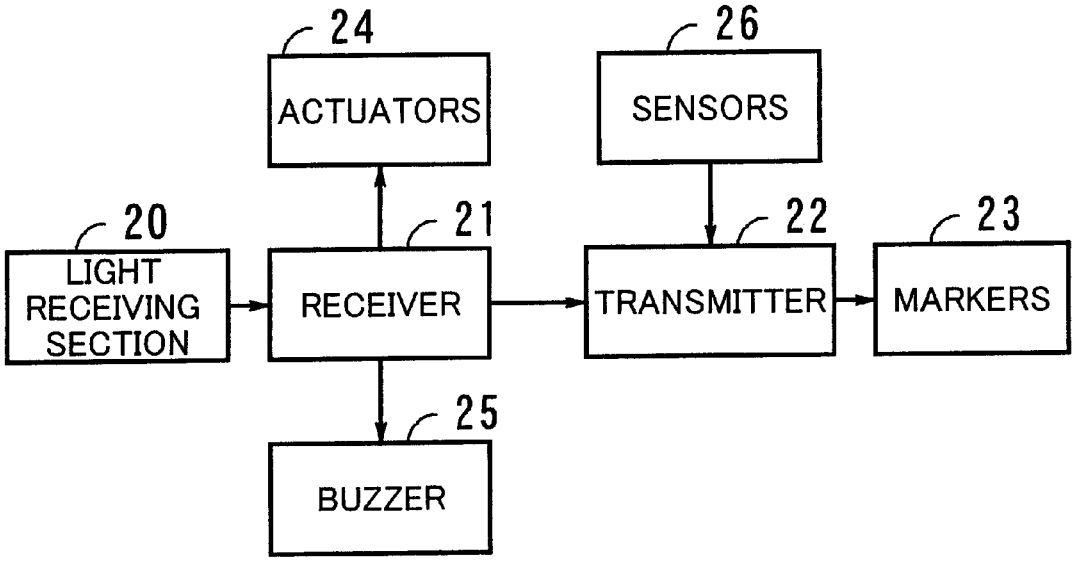
FIG. 5 is a block diagram showing, by way of example, a detailed configuration of a device provided in a succeeding vehicle.

FIG. 5 illustrates, by way of example, a detailed configuration of the device installed in the succeeding vehicle 2. As shown in the figure, the light receiving section 20, actuators 24 and a buzzer 25 are connected to the receiver 21, and sensors 26 and the markers 23 are connected to the transmitter 22.

The actuators 24 control the brake, accelerator, steering wheel, automatic transmission, etc., to control the traveling state of the local vehicle associated therewith.

The buzzer 25 is provided to warn the driver in case of emergency arising in the local vehicle or in the preceding vehicle 1, etc.

The sensors 26 detect the amount of operation of the brake, the accelerator opening, the amount of operation of the steering wheel, the state of automatic transmission, etc.

Figure 6:
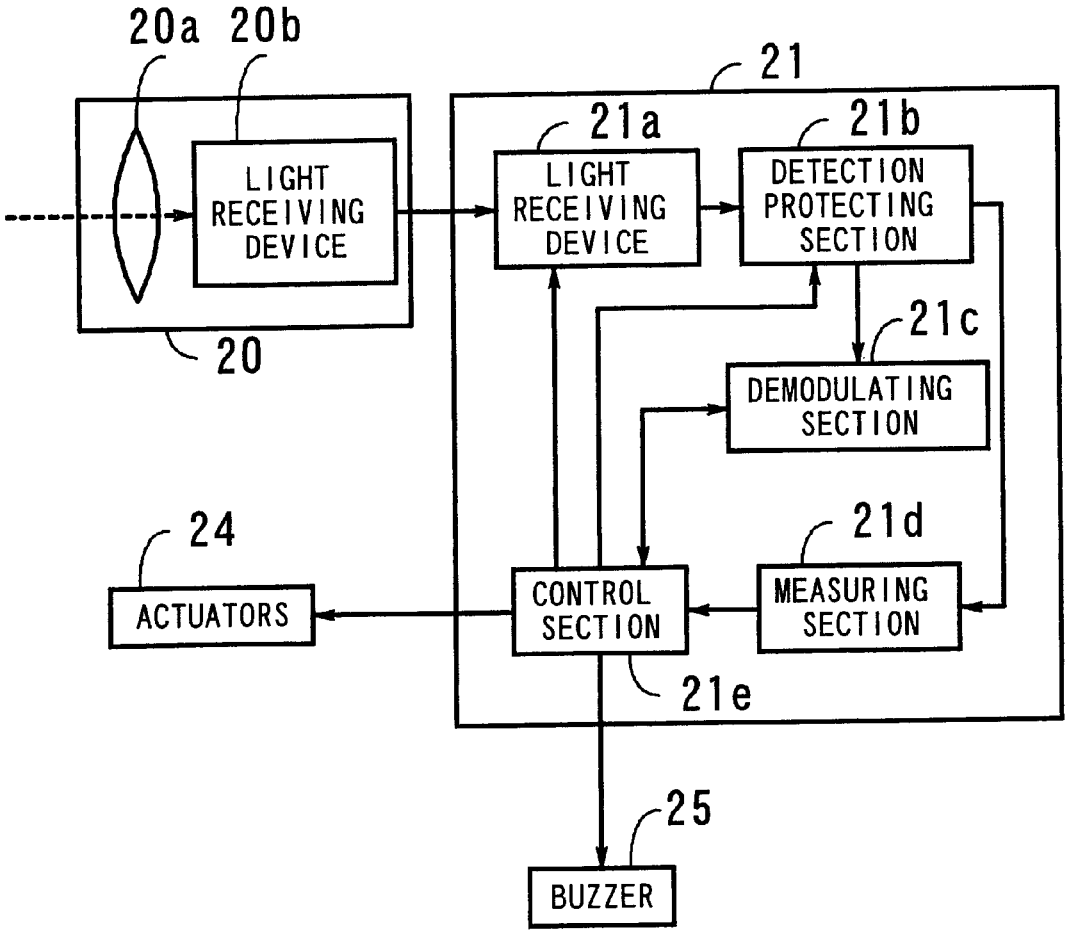
FIG. 6 is a block diagram showing, by way of example, a detailed arrangement of a receiver appearing in FIG. 5.

FIG. 6 shows, by way of example, details of the arrangement of the receiver 21 and its peripheral elements. As shown in the figure, the light receiving section 20 causes an optical image of the markers 10 to focus on the light receiving 15 surface of a light receiving device 20*b*.

The light receiving device 20*b*, which comprises a CCD (Charge Coupled Device) or the like, for example, converts the optical image of the markers 10 to corresponding image data and outputs the data.

The receiver 21 comprises a marker detecting section 21*a*, a detection protecting section 21*b*, a demodulating section 21*c*, a measuring section 21*d*, and a control section 21*e*.

The marker detecting section 21*a* detects and extracts marker images from the image data output from the light receiving section 20.

In cases where the marker blinking pattern has a frame structure described later, the detection protecting section 21*b* adjusts timing for the synchronization of frames so that information can be accurately extracted.

The demodulating section 21*c* demodulates the marker images output from the detection protecting section 21*b* to reproduce the original information, and supplies the information to the control section 21*e*.

The measuring section 21*d* subjects the marker images output from the detection protecting section 21*b* to predetermined image processing, to obtain the distance to the preceding vehicle 1 and the yaw angle, and notifies the control section 21*e* of the obtained distance and yaw angle.

The control section 21*e* controls the individual sections of the receiver, and also controls the actuators 24 in accordance with the information supplied from the demodulating section 21*c* and the measuring section 21*d*, to control the traveling state of the local vehicle associated therewith. Further, in case of emergency, the control section sounds the buzzer 25 to give warning to the driver.

Figure 7:
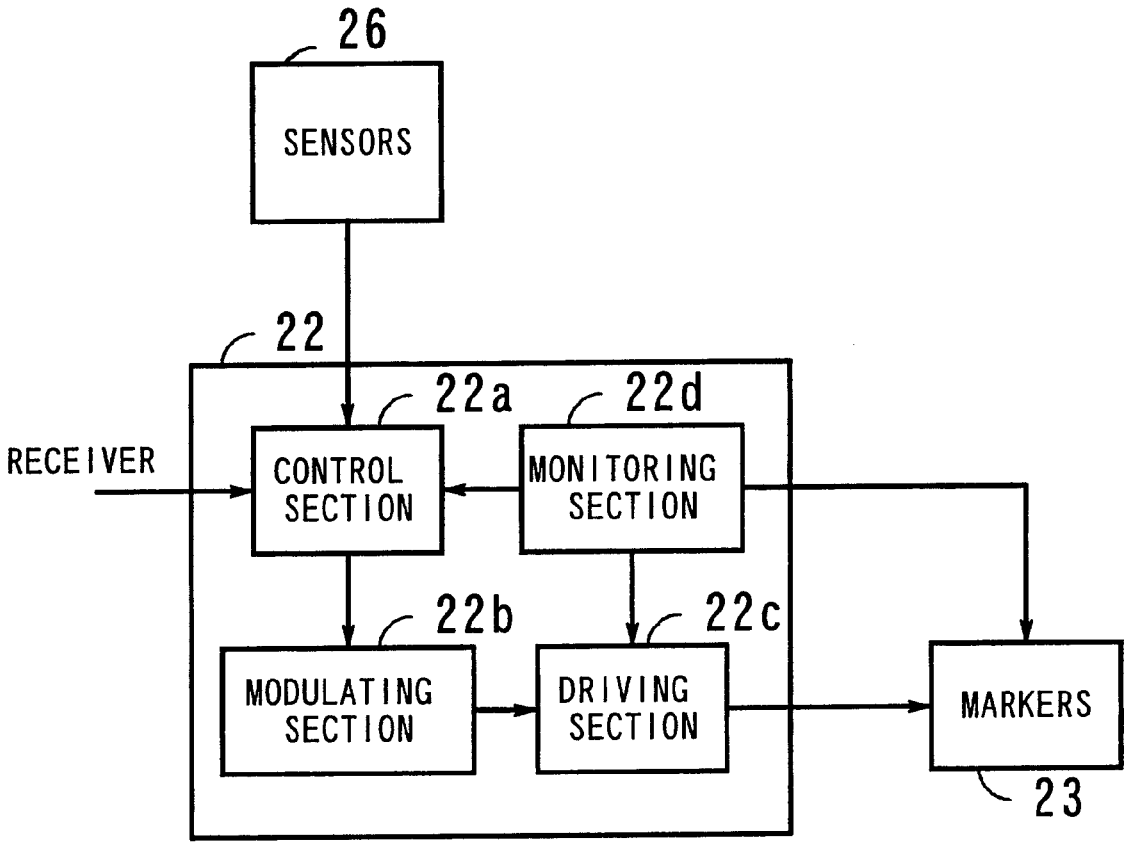
FIG. 7 is a block diagram showing, by way of example, a detailed arrangement of a transmitter appearing in FIG. 5.

FIG. 7 shows, by way of example, details of the arrangement of the transmitter 22 appearing in FIG. 5.

As shown in the figure, the transmitter 22 comprises a control section 22*a*, a modulating section 22*b*, a driving section 22*c*, and a monitoring section 22*d*.

The control section 22*a* controls the individual sections of the transmitter, and also supplies information input thereto from the receiver 21 or the sensors 26 to the modulating section 22*b* at predetermined timing.

The modulating section 22*b* modulates the information supplied thereto from the control section 22*a*, and supplies the obtained information to the driving section 22*c*.

In accordance with the information supplied from the modulating section 22*b*, the driving section 22*c* blinks the markers 23.

The monitoring section 22*d* monitors the states of the driving section 22*c* and the markers 23. If overcurrent flow or overheating of the driving section 22*c* or the markers 23 occurs, such abnormality is detected by the monitoring section and is notified to the control section 22*a*.

The operation of the above embodiment will be now described.

In the following, explanation will be first made of the operation in the case where local vehicle information is not superimposed on the marker blinking pattern, and then of the operation in the case where the local vehicle information is superimposed on the marker blinking pattern.

Figure 8:
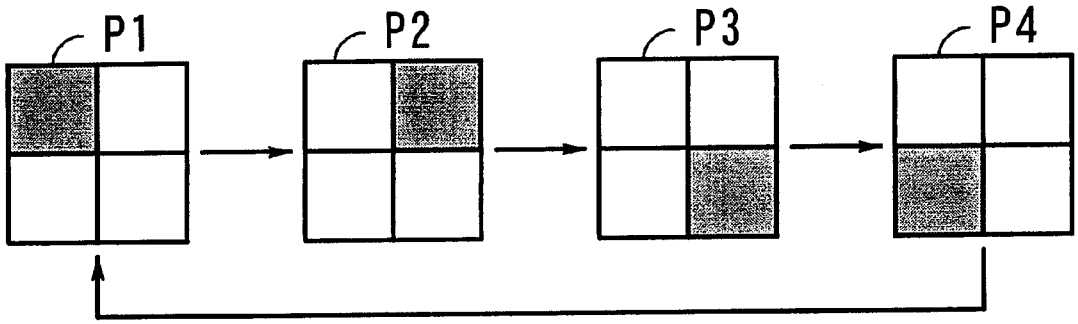
FIG. 8 is a diagram illustrating an example of a marker blinking pattern.

FIG. 8 illustrates an example of the marker blinking pattern. In this embodiment, the markers 10*a* and 10*b* are each segmented into four regions, and these regions are successively lit in order. In the example shown in FIG. 8, the upper left region, the upper right region, the lower right region and the lower left region are lit in the order mentioned (clockwise 25 direction), and the lit states of the individual regions are hereinafter called phases P1 to P4, respectively. The right and left-hand markers are caused to blink such that their phases synchronously change to an identical phase.

Figure 9:
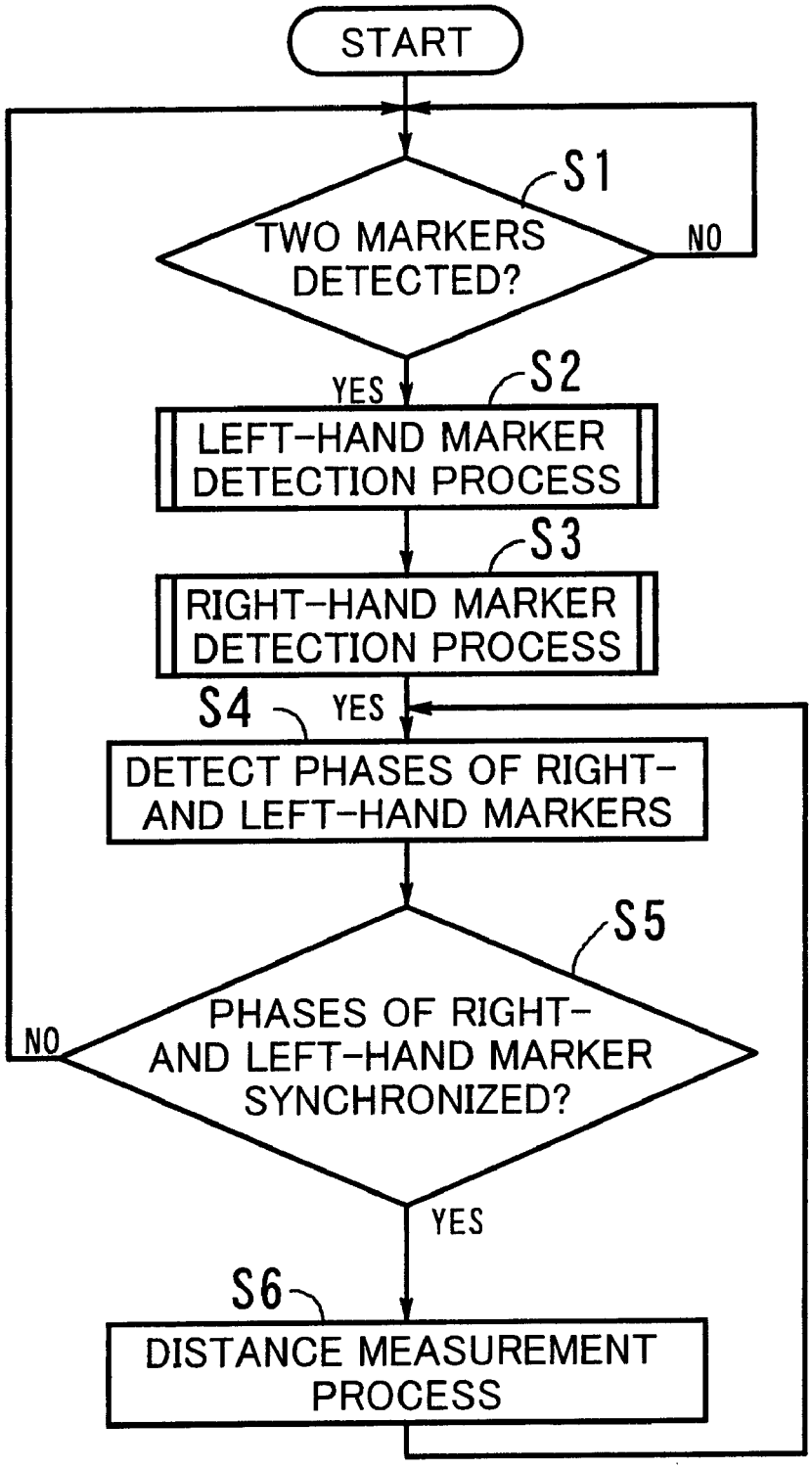
FIG. 9 is a flowchart illustrating, by way of example, a process for detecting the marker blinking pattern shown in FIG. 8.

In the succeeding vehicle 2 which receives the optical image of these markers, a process shown in FIG. 9 is executed to detect the distance to the preceding vehicle 1 and the yaw angle. Upon start of the process shown in the flowchart, the following steps are executed.

{S1} If the marker detecting section 21*a* detects two marker images from within the image data supplied from the light receiving section 20, the flow proceeds to Step S2; if not, the flow returns and repeatedly executes Step S1.

{S2} The marker detecting section 21*a* executes a process for detecting the left-hand marker 10*a*. This process is a subroutine and will be described in detail later.

{S3} The marker detecting section 21*a* executes a process for detecting the right-hand marker 10*b*. This process also is a subroutine and will be described in detail later.

{S4} The marker detecting section 21*a* detects the phases of the right- and left-hand markers.

{S5} The marker detecting section 21*a* determines whether or not the phases of the right- and left-hand markers are synchronized. If the phases are synchronized, the flow proceeds to Step S6; if not, the flowreturns to Step S1 and repeats the above process.

{S6} The marker detecting section 21*a* supplies the marker images to the measuring section 21*d* via the detection protecting section 21*b*. The measuring section 21*d* executes a distance measurement process by using the marker images, to obtain the distance between the vehicles and the yaw angle. Upon completion of the distance measurement process, the flow returns to Step S4, whereupon the above process is repeated. The distance measurement process will be described in detail later.

Figure 10:
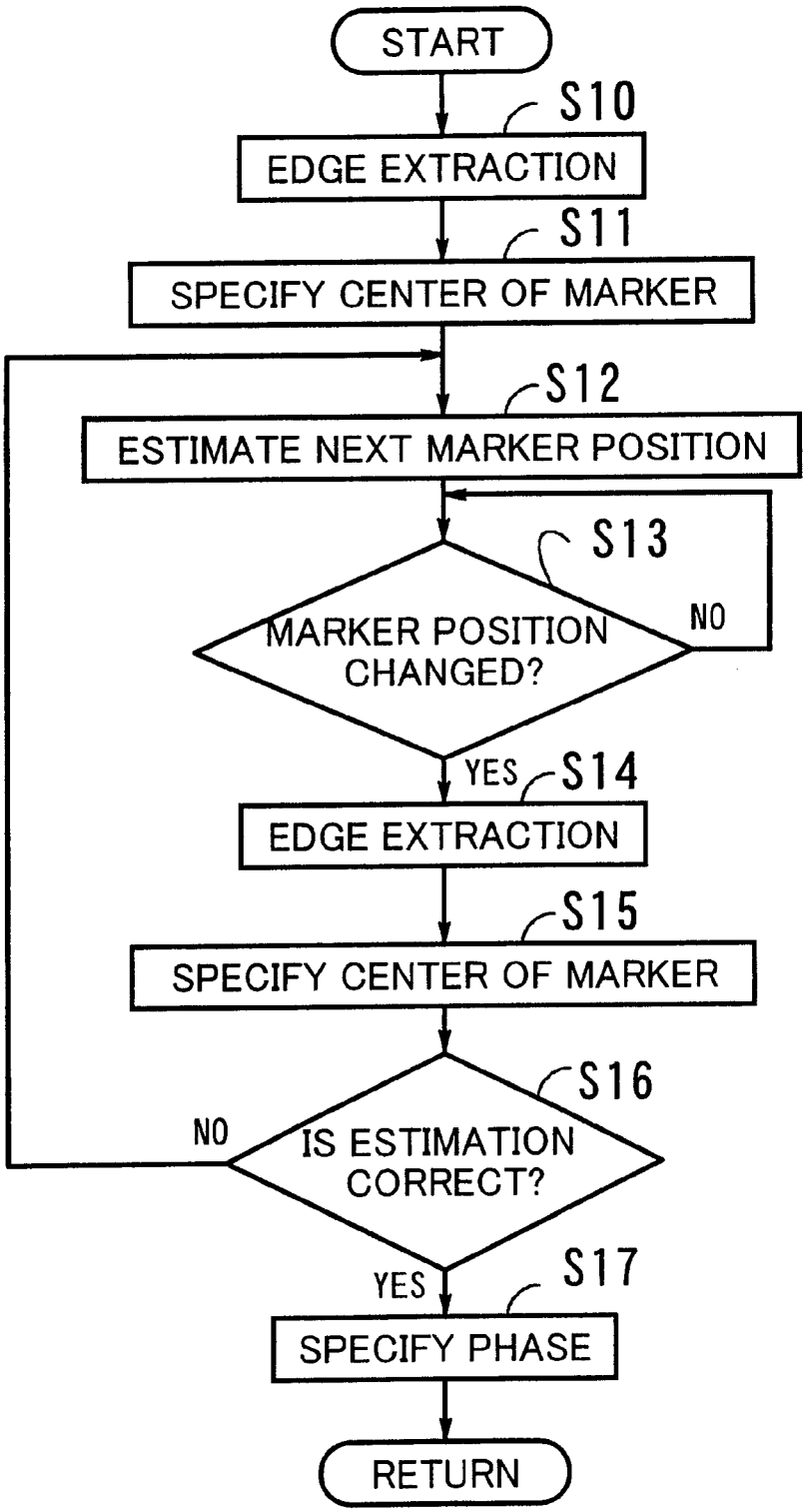
FIG. 10 is a flowchart illustrating an example of a left/right-hand marker detection process appearing in FIG. 9.

Referring now to FIG. 10, the right- and left-hand marker detection processes appearing in FIG. 9 will be described in detail. The right- and left-hand marker detection processes are substantially identical in content; therefore, in the following description, the left-hand marker detection process is taken as an example.

{S10} The marker detecting section 21*a* performs edge extraction on the image data.

{S11} The marker detecting section 21*a* specifies the center of the edge of the marker image situated on the left side.

{S12} The marker detecting section 21*a* estimates a marker position to be lit next.

Specifically, the lit position of the marker changes so as to rotate, as shown in FIG. 8, and therefore, the next lit position is estimated based on the current lit position.

{S13} The marker detecting section 21*a* determines whether or not the marker position has changed. If the marker position has changed, the flow proceeds to Step S14; if not, the flow returns and repeats Step S13.

The marker position may shift due to vibrations of the vehicle, etc. To prevent erroneous judgment from being made in such a situation, a threshold value may be set for the amount of shift of the marker position and when the threshold value is exceeded, it may be concluded that the marker position has changed.

{S14} The marker detecting section 21*a* performs edge extraction on the image data.

{S15} The marker detecting section 21*a* specifies the center of the edge of the marker image situated on the left side.

{S16} The marker detecting section 21*a* compares the marker position specified in Step S15 with the position estimated in Step S12, to determine whether or not the estimation is correct. If the estimation is correct, the flow proceeds to Step S17; if not, the flow returns to Step S12 to repeat the process described above.

When determining whether or not the estimation is correct, a certain allowable range should preferably be provided in consideration of factors such as vibrations of the vehicle.

{S17} The marker detecting section 21*a* specifies the phase.

Specifically, one of the phases P1 to P4 shown in FIG. 8 is specified.

According to the processes described above, when the blinking patterns of the detected right- and left-hand marker images are synchronized, the marker images are judged to be valid and thus the distance measurement process is executed, whereby erroneous detection of markers can be prevented.

The marker images detected in the aforementioned manner are supplied to the measuring section 21*d* via the detection protecting section 21*b*, whereupon the distance measurement process is carried out.

Figure 11:
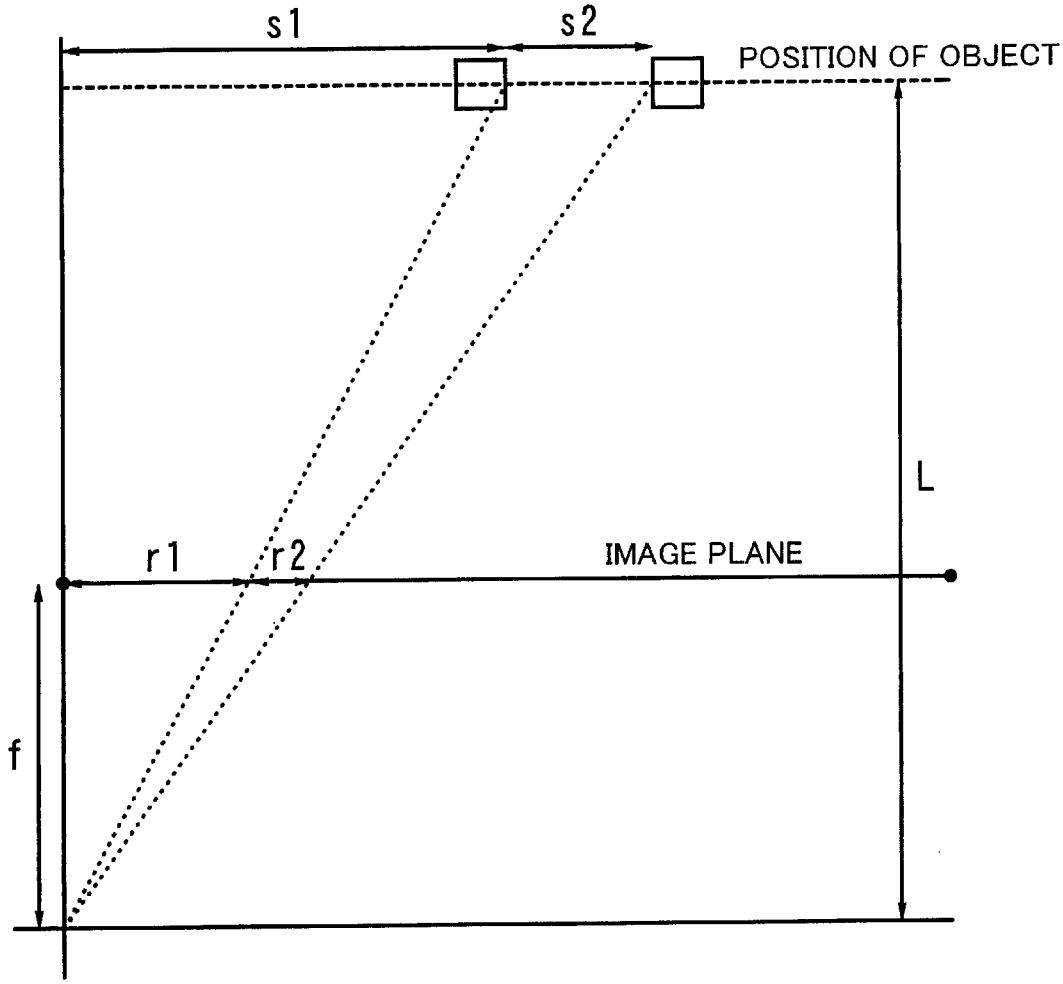
FIG. 11 is a diagram illustrating the principle of distance measurement.

FIG. 11 illustrates the principle of the distance measurement process.

Where the markers are situated at a distance of L in the direction of the optical axis of the optical system 20*a* and also at a distance of s1 in a direction perpendicular to the optical axis as shown in the figure, the relationship between the marker images projected on the light receiving device 20*b* and the markers can be plotted as shown in FIG. 11.

In the-figure, "f" denotes the focal distance of the optical system 20*a*, "s1" denotes the deviation of the markers from the optical axis, and "s2" denotes the distance between the markers. Also, "r1" denotes the deviation of the marker images from the optical axis on the image plane, and "r2" denotes the distance between the markers on the image plane.

In this case, provided the resolution of the light receiving device 20*b*, that is, the number of pixels per unit length is P, then f, L, P and m fulfill the following relationships:

$$f:L=P\cdot r1:s1 \tag{1}$$

$$f:L=P(r1+r2):(s1+s2) \tag{2}$$

Transforming equations (1) and (2) provides equations (3) and (4), respectively.

$$P'r\cdot 1\cdot L=f'\cdot s1 \tag{3}$$

$$P(r1+r2)L=f(s1+s2) \tag{4}$$

From equations (3) and (4), the following equation is derived:

$$L=f\cdot s2/(P'r2) \tag{5}$$

The focal distance f, the distance s2 between the markers and the resolution P are known; therefore, if the distance r2 between the marker images is obtained, then the distance L between the vehicles can be derived.

Figure 12:
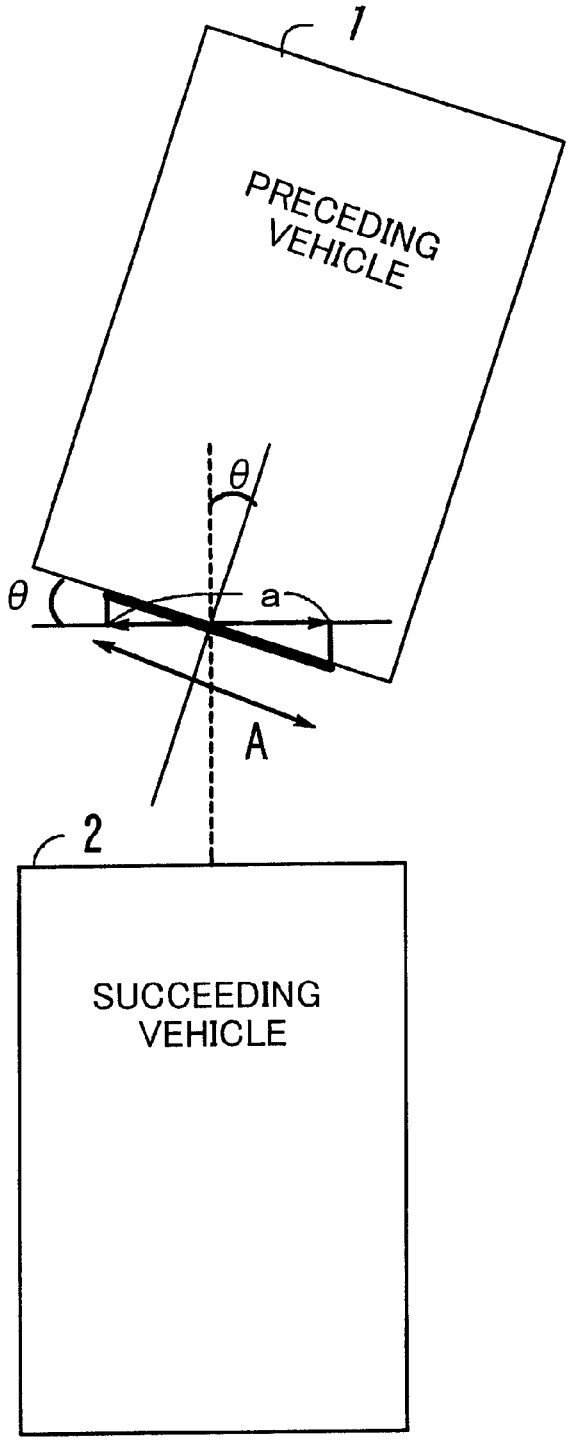
FIG. 12 is a diagram illustrating the principle of yaw angle detection.

Referring now to FIG. 12, the principle of yaw angle detection will be explained.

It is assumed that each of the markers (in this example, only one marker is illustrated for the sake of simplicity) affixed to the rear of the preceding vehicle 1 has a horizontal width A and a vertical width B (not shown), as shown in the figure.

If the advancing direction of the preceding vehicle 1 changes to the right by 0, the apparent horizontal width a of the marker as viewed from the succeeding vehicle 2 is expressed by the following equation:

$$a=A\cdot\cos\theta \tag{6}$$

The apparent horizontal and vertical widths vary depending on the position of the succeeding vehicle relative to the preceding vehicle, but their ratio remains unchanged insofar as the yaw angle is the same. Accordingly, putting A/B=c and assuming that the ratio of the horizontal width to the vertical width detected on the side of the succeeding vehicle 2 is z, then the following relationship is fulfilled:

$$z=a/B=A\cdot\cos\theta/B=c\cdot\cos\theta \tag{7}$$

Transforming this equation provides the following equation:

$$\theta=\cos^{-1}z/c \tag{8}$$

By using equation (8), it is possible to obtain the yaw angle θ.

The distance between the vehicles and the yaw angle obtained in this manner are supplied to the control section 21*e*. In accordance with these values, the control section 21*e* controls the actuators 24, thereby to appropriately control the traveling state of the vehicle.

In the embodiment described above, each marker is segmented into a plurality of regions and the individual regions of the right- and left-hand markers are caused to blink in synchronism with each other, so that erroneous detection of markers can be prevented.

Although in the above embodiment the right- and left-hand markers are each segmented into four regions, they may of course be segmented in different ways.

The following describes a method of periodically blinking the markers as a whole, instead of segmenting the markers.

Figure 13:
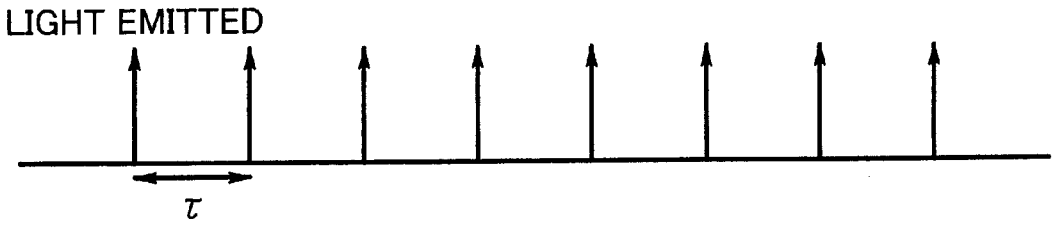
FIG. 13 is a diagram illustrating another example of the marker blinking pattern.

FIG. 13 illustrates an example of a pattern of blinking the markers with time. In the illustrated example, the markers are blinked at intervals of τ. Also in this case, the right- and left-hand markers are caused to blink in synchronism with each other.

Figure 14:
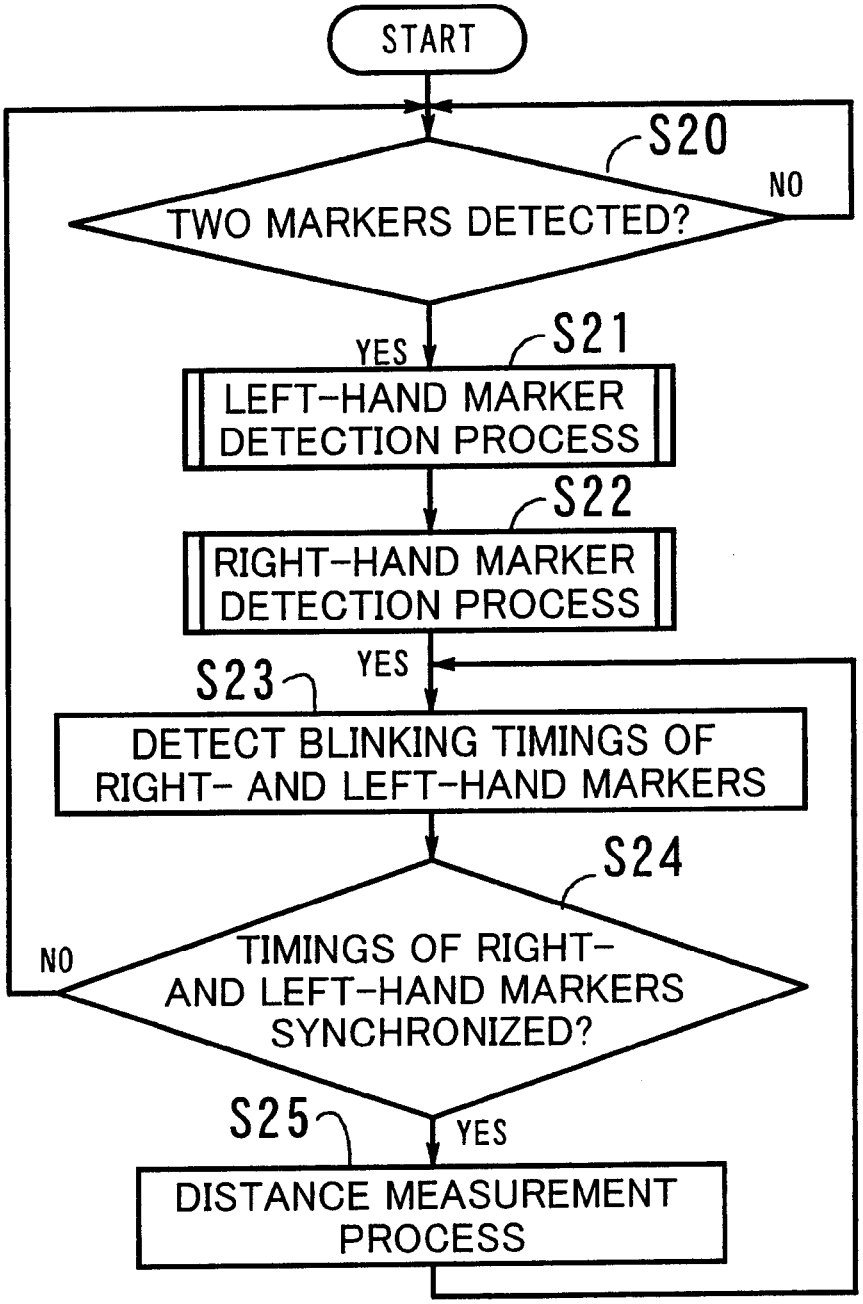
FIG. 14 is a flowchart illustrating, by way of example, a process for detecting the marker blinking pattern shown in FIG. 13.

FIG. 14 is a flowchart showing, by way of example, a process for detecting the markers which blink according to the blinking pattern shown in FIG. 13. Upon start of the process, the following steps are executed.

{S20} If the marker detecting section 21*a* detects two marker images from within the image data supplied from the light receiving section 20, the flow proceeds to Step S21; if not, the flow returns and repeatedly executes Step S20.

{S21} The marker detecting section 21*a* executes a process for detecting the left-hand marker 10*a*. This process is a subroutine and will be described in detail later.

{S22} The marker detecting section 21*a* executes a process for detecting the right-hand marker 10*b*. This process also is a subroutine and will be described in detail later.

{S23} The marker detecting section 21*a* detects the blinking timings of the right- and left-hand markers.

{S24} The marker detecting section 21*a* determines whether or not the blinking timings of the right- and left-hand markers are synchronized. If the blinking timings are synchronized, the flow proceeds to Step S25; if not, the flow returns to Step S20 and repeats the process described above.

{S25} The marker detecting section 21*a* supplies the marker images to the measuring section 21*d* via the detection protecting section 21*b*. The measuring section 21*d* executes the distance measurement process by using the marker images, to obtain the distance between the vehicles and the yaw angle. Upon completion of the distance measurement process, the flow returns to Step S23, whereupon the above process is repeated.

Figure 15:
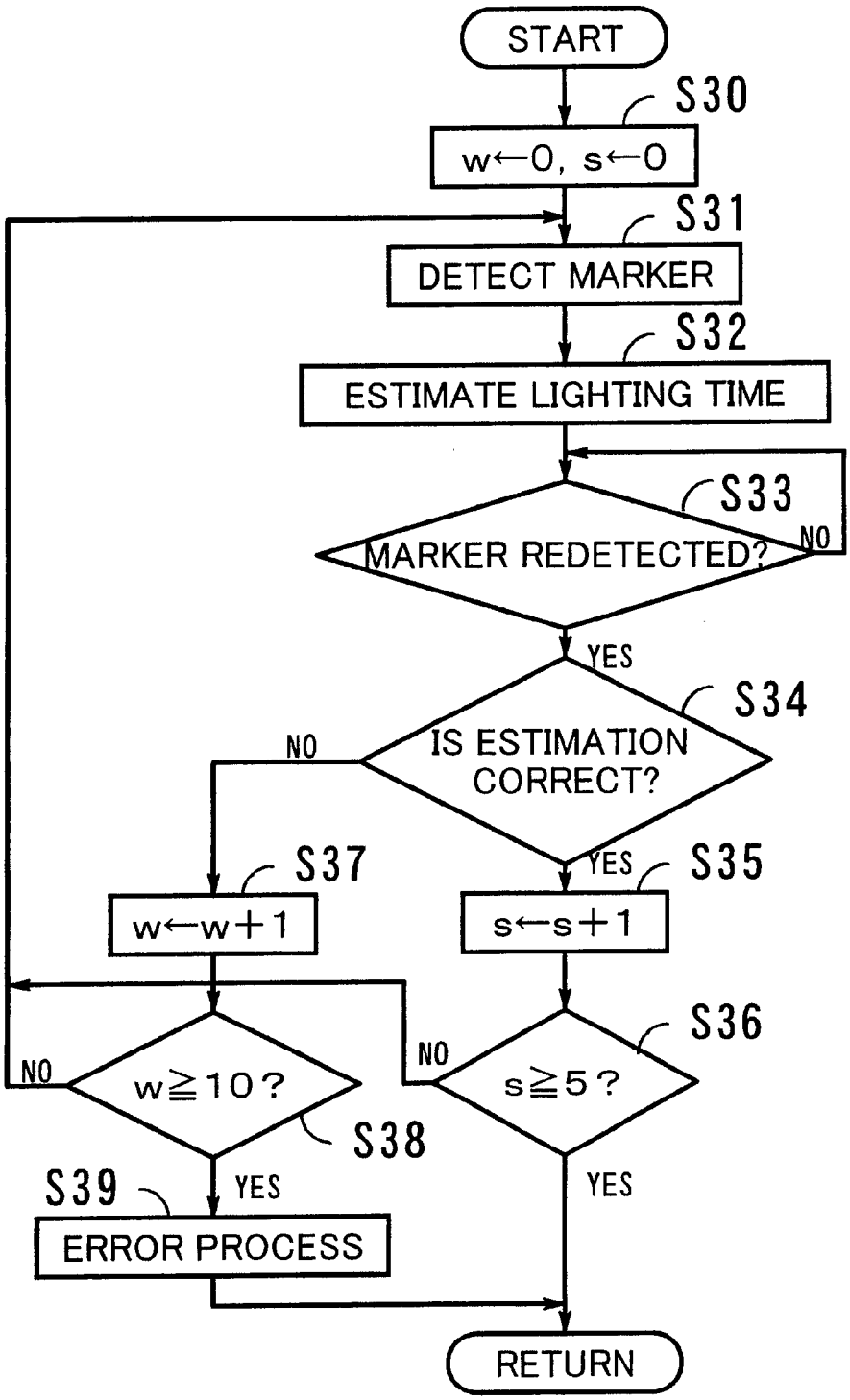
FIG. 15 is a flowchart illustrating an example of a left/right-hand marker detection process appearing in FIG. 14.

Referring now to FIG. 15, the right- and left-hand marker detection processes appearing in FIG. 14 will be described in detail. The right- and left-hand marker detection processes are substantially identical in content; therefore, in the following description, the left-hand marker detection process is taken as an example.

{S30} The marker detecting section 21*a* sets variables w and s both to an initial value of "0".

{S31} The marker detecting section 21*a* detects the left-hand marker from the image data.

{S32} The marker detecting section 21*a* estimates a time at which the marker will be lit next time.

In the example shown in FIG. 13, lighting of the marker after a lapse of the time t is estimated.

{S33} The marker detecting section 21*a* determines whether or not the marker has been detected again. If the marker has been detected again, the flow proceeds to Step S34; if not, the flow returns to repeat Step S33.

{S34} The marker detecting section 21*a* determines whether or not the actual time period from the detection of the marker in Step S31 to the redetection of the marker in Step S33 coincides with the blinking interval estimated in Step S32. If the two coincide, the flow proceeds to Step S35; if not, the flow proceeds to Step S37.

{S35} The marker detecting section 21*a* increments the value of the variable s by "1".

{S36} The marker detecting section 21*a* compares the value of the variable s with "5". If the value of the variable is equal to or greater than "5", the flow resumes the original process; if not, the flow returns to Step S31 to repeat the above process.

{S37} The marker detecting section 21*a* increments the value of the variable w by "1".

{S38} The marker detecting section 21*a* compares the value of the variable w with "10". If the value of the variable is equal to or greater than "10", the flow proceeds to Step S39; if not, the flow returns to Step S31 to repeat the above process.

{S39} The marker detecting section 21*a* concludes that the marker has not been properly detected; accordingly, an error process is executed and the original process is resumed.

According to the processes described above, when the markers are individually blinked at regular intervals and at the same time the blinking intervals of the right- and left-hand markers are synchronized, it is judged that the markers are properly detected, whereby erroneous detection of markers can be prevented. Namely, it is rare that the markers of different vehicles blink synchronously, and therefore, whether the markers are detected properly or not can be determined by the aforementioned procedure.

In the following, an embodiment wherein predetermined information is superimposed on the marker blinking pattern to transmit the information to a succeeding vehicle will be described.

Figure 16:
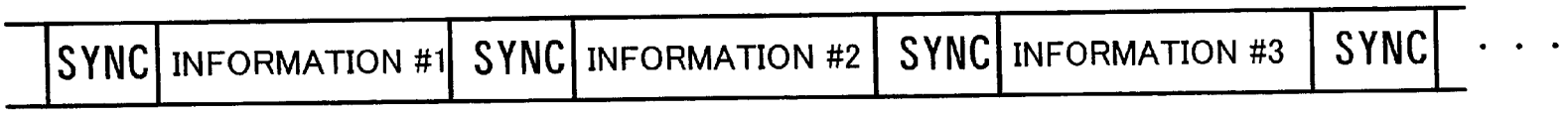
FIG. 16 is a diagram showing an example of superimposing information on the marker blinking pattern.

FIG. 16 illustrates a structure of information superimposed on the blinking pattern. As shown in the figure, each of information #1 to #3, which constitute actual data, is preceded and succeeded by "sync" which is a unique pattern for attaining synchronization. The information #1 to #3 include a variety of information that needs to be notified to the succeeding vehicle 2. The actual data is structured such that it does not include a pattern identical with the blinking pattern of sync.

Figure 17:
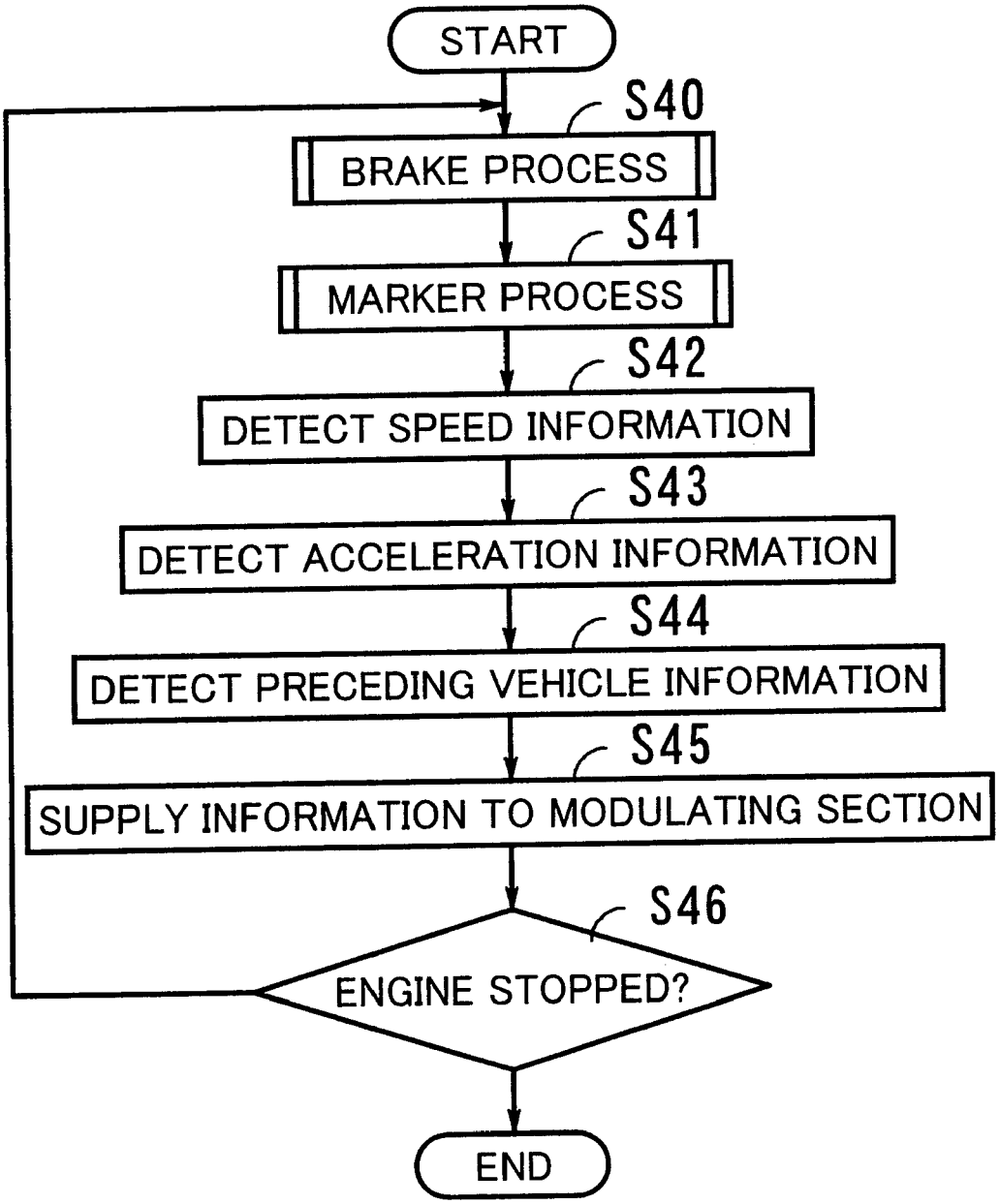
FIG. 17 is a flowchart illustrating an example of a process for sending out information by means of the blinking pattern shown in FIG. 16.

Referring now to FIG. 17, a process for sending out information by means of the blinking pattern shown in FIG. 16 will be described. Upon start of the process shown in the flowchart, the following steps are executed.

{S40} The control section 22*a* executes a "brake process" whereby braking of the local vehicle associated therewith or of the preceding vehicle is detected and notified to the succeeding vehicle.

This process will be described in detail later with reference to FIG. 18.

{S41} The control section 22*a* executes a "marker process" whereby abnormality of the markers of the local vehicle associated therewith is detected and notified to the succeeding vehicle.

Details of this process will be described later with reference to FIG. 19.

{S42} The control section 22*a* looks up the information supplied thereto from the sensors 26 and detects information on the speed of the local vehicle.

{S43} The control section 22*a* looks up the information supplied thereto from the sensors 26 to detect information on the acceleration of the local vehicle.

{S44} The control section 22*a* detects preceding vehicle information which has been transmitted from the preceding vehicle and received by the receiver.

The information from the preceding vehicle chiefly includes emergency information (e.g., information indicating braking or abnormality of the markers), but other information such as vehicle speed, acceleration, etc. may also be transmitted.

{S45} The control section 22*a* supplies the speed information, acceleration information and preceding vehicle information to the modulating section 22*b*.

Consequently, the modulating section 22*b* inserts the information supplied thereto appropriately between the synchronization patterns "sync", as shown in FIG. 16,and supplies the resulting pattern to the driving section 22*c*. In accordance with the pattern supplied from the modulating section 22*b*, the driving section 22*c* blinks the markers.

{S46} The control section 22*a* determines whether or not the engine has been stopped. If the engine has been stopped, the process is ended; if not, the flow returns to Step S40 and repeats the above-described process.

Figure 18:
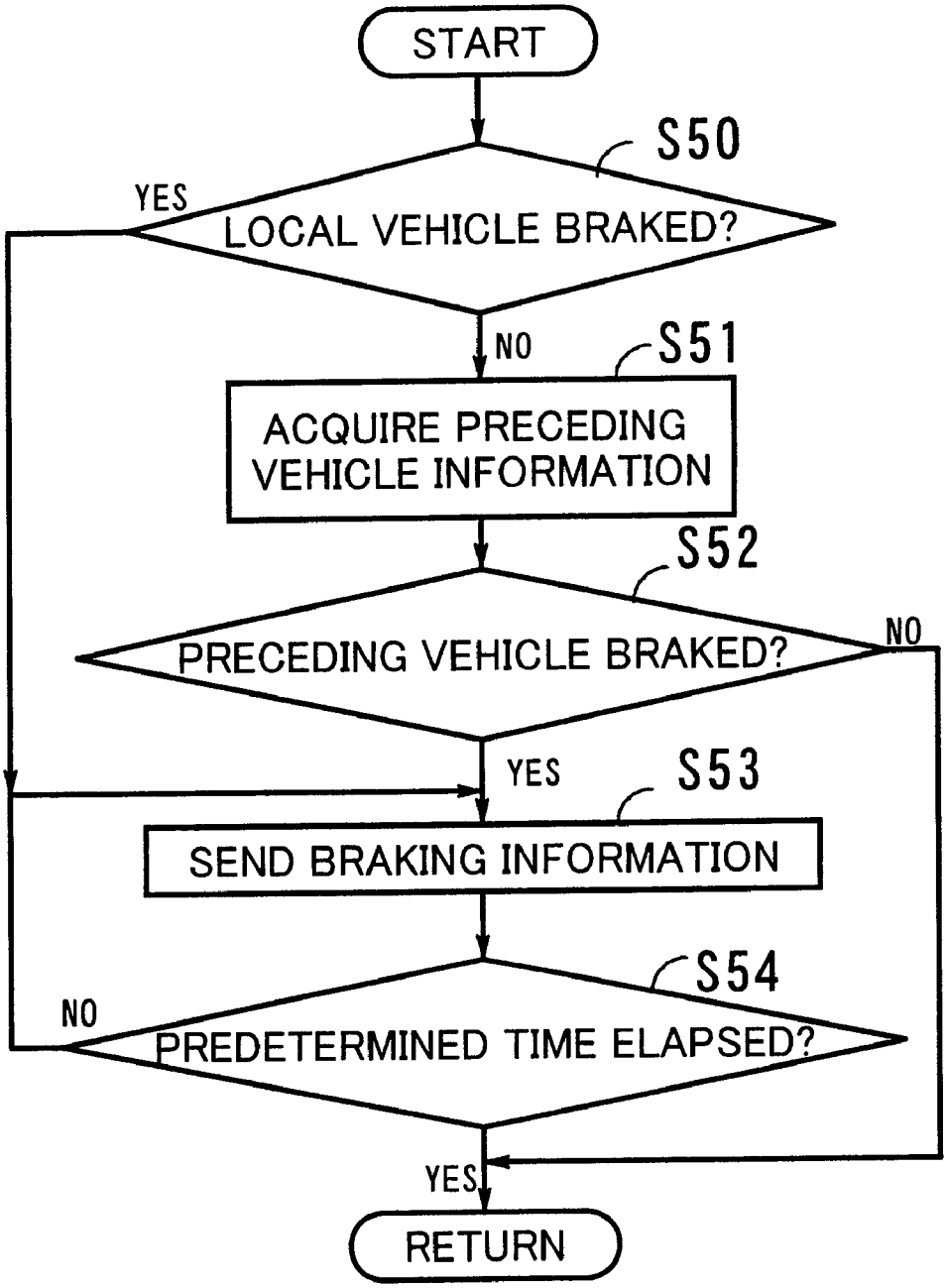
FIG. 18 is a flowchart illustrating details of a brake process appearing in FIG. 17.

Referring now to FIG. 18, the "brake process" in Step S40 in FIG. 17 will be described in detail.

{S50} The control section 22*a* looks up the outputs from the sensors 26 to determine whether or not the brake of the local vehicle has been applied. If the brake has been applied, the flow proceeds to Step S53; if not, the flow proceeds to Step S51.

{S51} The control section 22*a* acquires preceding vehicle information received by the receiver 21.

{S52} The control section 22*a* looks up the information transmitted from the preceding vehicle, to determine whether or not the brake of the preceding vehicle has been applied. If the brake has been applied, the flow proceeds to Step S53; if not, the original process is resumed.

The preceding vehicle information to be acquired may include not only information about the vehicle immediately ahead but also information about the vehicle traveling in front of the immediately preceding vehicle.

{S53} The control section 22*a* supplies the braking information to the modulating section 22*b*. As a result, the braking information is sent out to the succeeding vehicle.

{S54} The control section 22*a* determines whether or not a predetermined time has elapsed. If the predetermined time has elapsed, the original process is resumed; if not, the flow returns and repeats Step S53.

For example, if a time period (e.g., 0.5 second) necessary for the braking information to be received without fail by the succeeding vehicle has elapsed, the original process is resumed, and if not, the braking information is repeatedly sent out.

Figure 19:
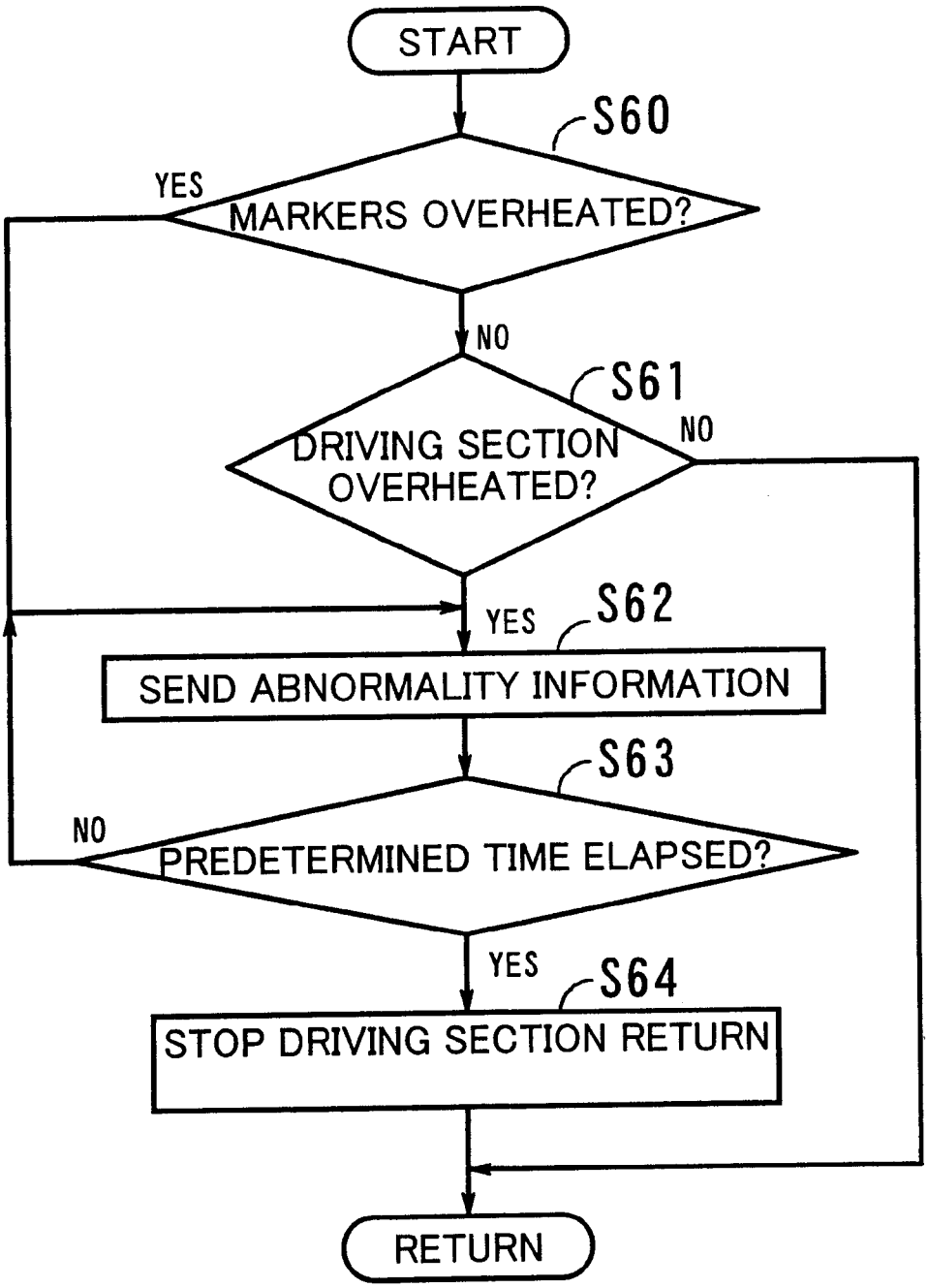
FIG. 19 is a flowchart illustrating details of a marker process appearing in FIG. 17.

Referring now to FIG. 19, the "marker process" in Step 20 S41 in FIG. 17 will be described in detail.

{S60} The control section 22*a* checks the output from the monitoring section 22*d* to determine whether or not the markers 23 are overheated. If the markers are overheated, the flow proceeds to Step S62; if not, the flow proceeds to Step S61.

{S61} The control section 22*a* checks the output from the monitoring section 22*d* to determine whether or not the driving section 22*c* is overheated. If the driving section is overheated, the flow proceeds to Step S62; if not, the original process is resumed.

{S62} The control section 22*a* supplies the modulating section 22*b* with abnormality information indicating abnormality of the markers. As a result, the abnormality information is sent out to the succeeding vehicle.

{S63} The control section 22*a* determines whether or not a predetermined time has elapsed. If the predetermined time has elapsed, the flowproceeds to Step S64; if not, the flow returns and repeats Step S62.

For example, if a time period (e.g., 0.5 second) necessary for the abnormality information to be received without fail by the succeeding vehicle has elapsed, the original process is resumed, and if not, the abnormality information is repeatedly 15 sent out.

{S64} The control section 22*a* stops the driving section 22*c* to thereby stop the operation of the markers.

Figure 20:
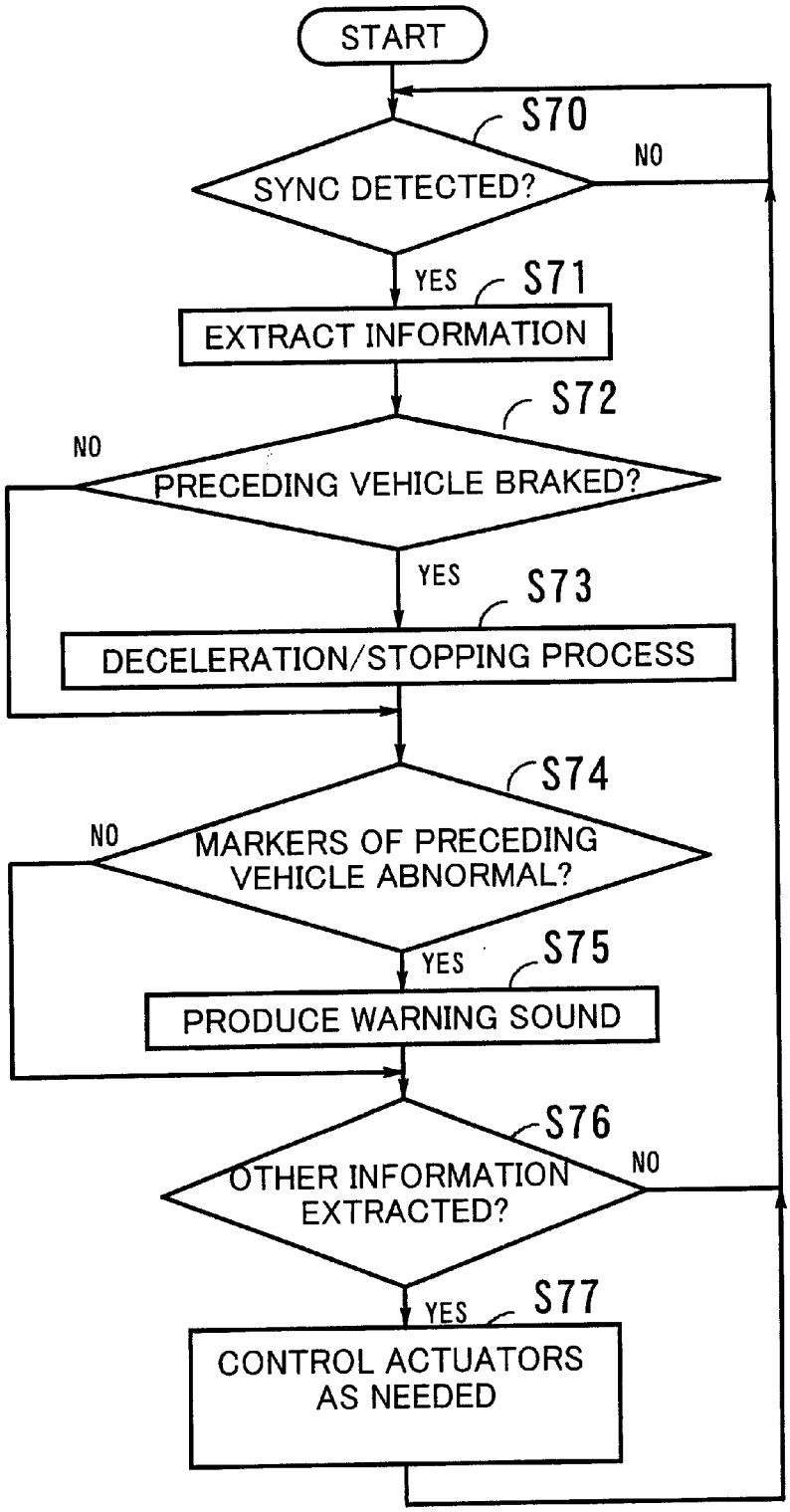
FIG. 20 is a flowchart illustrating a process for receiving information sent out by the process shown in FIG. 16.

Referring now to FIG. 20, a process for receiving the information sent out by the aforementioned processes will be 20 described. Upon start of the process shown in the flowchart, the following steps are executed.

{S70} The demodulating section 21*c* determines whether or not sync has been detected. If sync has been detected, the flow proceeds to Step S71; if not, the flow returns and repeats 25 Step S70.

{S71} The demodulating section 21*c* extracts the information inserted between syncs and supplies the extracted information to the control section 21*e*.

{S72} The control section 21*e* looks up the extracted information to determine whether or not the preceding vehicle has been braked. If the preceding vehicle has been braked, the flow proceeds to Step S73; if not, the flow proceeds to Step S74.

{S73} The control section 21*e* sends control information to the actuators 24 to perform a deceleration or stopping process.

{S74} The control section 21*e* looks up the extracted information to determine whether or not the markers of the preceding vehicle are abnormal. If the markers are abnormal, the flow proceeds to Step S75; if not, the flow proceeds to Step S76.

Namely, in the case where the extracted information includes the abnormality information, the flow proceeds to Step 15 S75.

{S75} The control section 21*e* controls the buzzer 25 to produce a warning sound.

{S76} The control section 21*e* determines whether or not other information has been extracted. If other information has been extracted, the flow proceeds to Step S77; if not, the flow returns to Step S70 and repeats the above process.

{S77} The control section 21*e* appropriately controls the actuators 24 in accordance with the extracted information, to control the traveling state of the local vehicle associated therewith.

According to the processes described above, information about the traveling state of the preceding vehicle is superimposed on the marker blinking pattern to be notified to the succeeding vehicle. The information is looked up by the succeeding vehicle, whereby the succeeding vehicle can be controlled with reliability such that it follows the preceding vehicle.

Braking and fault of the markers, for example, are checked most preferentially and are repeatedly transmitted to the succeeding vehicle for a predetermined time so that the succeeding vehicle can detect such information without fail, thus making it possible to preferentially transmit important information.

In cases where braking or fault of the markers has occurred, such information may be transmitted preferentially over the other information by an interrupt process.

According to the present invention, in the vehicle traveling control system in which information from markers affixed to a preceding vehicle is looked up to control a succeeding vehicle, the preceding vehicle has blinking means for blinking the markers according to a predetermined pattern, and the succeeding vehicle has imaging means for acquiring an image of light from the markers, specifying means for specifying images of the markers from within the image output from the imaging means, and validity determining means for determining validity of the marker images based on a blinking pattern of the marker images specified by the specifying means. Accordingly, the markers can be detected with reliability, making it possible to enhance safety.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A vehicle traveling control system for controlling a succeeding vehicle by looking up information from markers affixed to a preceding vehicle, wherein the preceding vehicle has blinking means for blinking the markers according to a predetermined pattern, and the succeeding vehicle has imaging means for acquiring an image of light from the markers, specifying means for specifying images of the markers from within the image output from the imaging means, validity determining means for determining validity of the marker images based on a blinking pattern of the marker images specified by the specifying means, and control means for controlling the succeeding vehicle based on information received from the validity determining means.

2. The vehicle traveling control system according to claim 1, wherein the succeeding vehicle further includes distance measuring means for measuring a distance to the preceding vehicle by using the marker images when it is judged by the validity determining means that the marker images are valid.

3. The vehicle traveling control system according to claim 2, wherein the distance measuring means calculates the distance to the preceding vehicle based on a distance between the marker images.

4. The vehicle traveling control system according to claim 1, wherein the succeeding vehicle further includes yaw angle detecting means for detecting a yaw angle by using a ratio of length between two sides of the marker images when it is judged by the validity determining means that the marker images are valid.

5. The vehicle traveling control system according to claim 1, wherein the preceding vehicle further includes information collecting means for collecting information indicating a traveling state of the preceeding vehicle or of a third vehicle ahead of the preceeding vehicle, and modulating means for controlling the blinking means in accordance with the information collected by the information collecting means, to modulate the blinking pattern, and the succeeding vehicle further includes demodulating means for demodulating original information from the blinking pattern of the marker images, and the control means controls a traveling state of the succeeding vehicle in accordance with the information obtained from the demodulating means.

6. The vehicle traveling control system according to claim 5, wherein the preceding vehicle further includes marker state detecting means for detecting states of the markers, abnormality information supply means for generating abnormality information indicating abnormality of the markers and supplying the abnormality information to the modulating means when abnormality of the markers is detected by the marker state detecting means, and marker stopping means for stopping operation of the markers when the abnormality information is supplied to the modulating means from the abnormality information supply means.

7. The vehicle traveling control system according to claim 6, wherein the succeeding vehicle further includes warning means for making a warning when the abnormality information is demodulated by the demodulating means.

8. The vehicle traveling control system according to claim 5, wherein the preceding vehicle further includes braking operation detecting means for detecting a braking operation, and braking information supply means for generating braking information and supplying the braking information to the modulating means when a braking operation is detected by the braking operation detecting means.

9. The vehicle traveling control system according to claim 8, wherein the succeeding vehicle further includes decelerating means for decelerating the local vehicle associated therewith when the braking information is demodulated by the demodulating means.

10. A vehicle control device for controlling a local vehicle associated therewith by looking up information from markers affixed to a preceding vehicle, preceding the local vehicle, comprising:

imaging means for acquiring an image of light from the markers of the preceding vehicle;

specifying means for specifying images of the markers from an output of said imaging means;

validity determining means for determining validity of the marker images based on a blinking pattern of the marker images specified by said specifying means; and control means for controlling the local vehicle based on information received from the validity determining means.

11. A method of controlling a second vehicle, comprising:

selectively emitting light from a light emitting element on a first vehicle according to a predetermined pattern;

receiving the pattern at the second vehicle;

determining a validity of the received pattern; and controlling the second vehicle based on information received from the determining of the validity.

12. A vehicle traveling control system, comprising:

a first vehicle comprising markers to emit light according to a pattern; and a second vehicle comprising:

an imaging unit to acquire the emitted light from the markers, a specifying unit to specify images of the markers based on the acquired light, a validity determining unit to determine a validity of the marker images, and a control unit to control the second vehicle based on information received from the validity determining unit.

* * * * *